US006506070B1

(12) United States Patent
Huang

(10) Patent No.: US 6,506,070 B1
(45) Date of Patent: Jan. 14, 2003

(54) ELECTRICAL CONNECTOR HAVING DEVICE FOR CONTROLLED LATCHING MOVEMENT

(75) Inventor: Wayne Huang, Alhambra, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/909,520

(22) Filed: Jul. 20, 2001

(51) Int. Cl.[7] ..... H01R 13/627; H01R 13/625; H01R 24/00

(52) U.S. Cl. ..... 439/352; 439/344; 439/345; 439/676

(58) Field of Search ..... 439/344, 449, 439/354, 345, 352, 346, 347, 355, 357, 676

(56) References Cited

U.S. PATENT DOCUMENTS 4,904,202 A * 2/1990 Uchida ..... 439/372
5,562,475 A * 10/1996 Kern et al. ..... 439/344
5,579,425 A * 11/1996 Lampert et al. ..... 385/59
5,672,071 A * 9/1997 Ceru ..... 437/353

* cited by examiner

*Primary Examiner*—Brian Sircus
*Assistant Examiner*—Chandrika Prasad
(74) *Attorney, Agent, or Firm*—Wei Te Chung

(57) ABSTRACT

An electrical connector (1; 2) comprises an insulative housing (10; 20), a plurality of terminals received in the insulative housing, a latch (12; 22) extending from the insulative housing and a restraining device (13; 24). The latch has a barb (121; 221) interfering with an interposition of a mating connector and an impending end (122; 222). The restraining device has an end connecting with the impending end of the latch and another end connecting with the insulative housing.

5 Claims, 4 Drawing Sheets

ELECTRICAL CONNECTOR HAVING DEVICE FOR CONTROLLED LATCHING MOVEMENT

CROSS-REFERENCES TO RELATED APPLICATIONS

This application is related to a co-pending U.S. patent application Ser. No. 09/826995 filed on Apr. 4, 2001, titled "ELECTRICAL CONNECTOR" by the same inventors and assigned to the same assignee of the present application.

BACKGROUND OF THE INVENTION

1. Field of the Invention

The present invention is generally related to an electrical connector having a latch thereon, and more particular to an electrical connector having a device for limiting movement of a latch thereof, whereby effectively preventing the latch from being damaged.

2. Description of the Related Prior Art

Electrical connector with latches is widely used between plug and receptacle connectors to ensure reliable electrical connection therebetween. An early use of latch is shown in U.S. Pat. Nos. 4,221,458 and 4,379,609. These patents describe modular jacks each having a latch, wherein the latch has an impending end which is apt to be damaged when improperly drawn outwardly. The advanced designs are shown in Taiwan Patent Application Nos. 83201276 and 81213465. These patents describe modular jacks each having a shield to receive an impending end of a latch thereof. The latch is almost free from being damaged for the impending end will not be drawn outwardly in use. However, users must press the impending end downwardly when pulling the modular jack out of a receptacle. Since there is not enough space for placing a finger between the modular jack and the receptacle in order to press the impending end of the latch to pull the modular jack out, it is not convenient in practical use.

Hence, an improved electrical connector is required to overcome the disadvantages of the prior art.

BRIEF SUMMARY OF THE INVENTION

Therefore, an objective of the present invention is to provide an electrical connector having a latch and a restraining device to limit the movement of the latch.

Another objective of the present invention is to provide an electrical connector assembly comprising a plug connector and a receptacle connector, wherein the plug connector has a latch and defines a restraining device to limit movement of an impending end of the latch, whereby the plug connector is easy to be pulled out from the receptacle.

To achieve the above-mentioned objectives, an electrical connector in accordance with the present invention comprises an insulative housing having a first face and a connecting piece extending rearwardly therefrom above the first face, a latch extending from the insulative housing and a restraining device. The latch has a barb and an impending end at a rear portion thereof. The restraining has a first end connected with the impending end and a second end movably connected with the connecting piece. Connection between the restraining device and the impending end may limit movement of the impending end to prevent the latch from being broken. When the electrical connector is inserted into a mating connector, the impending end of the latch is easy accessible.

According to another embodiment of the present invention, an electrical connector comprises an insulative housing, a latch and a restraining device. The latch has a barb and an impending end at a rear portion thereof. The restraining device is integrally formed on the insulative housing with a limiting portion thereof positioned above the impending end of the latch and with a rear portion of the impending end extending rearwardly beyond the limiting portion.

Other objects, advantages and novel features of the invention will become more apparent from the following detailed description of the present embodiment when taken in conjunction with the accompanying drawings.

DETAILED DESCRIPTION OF THE INVENTION

Figure 1:
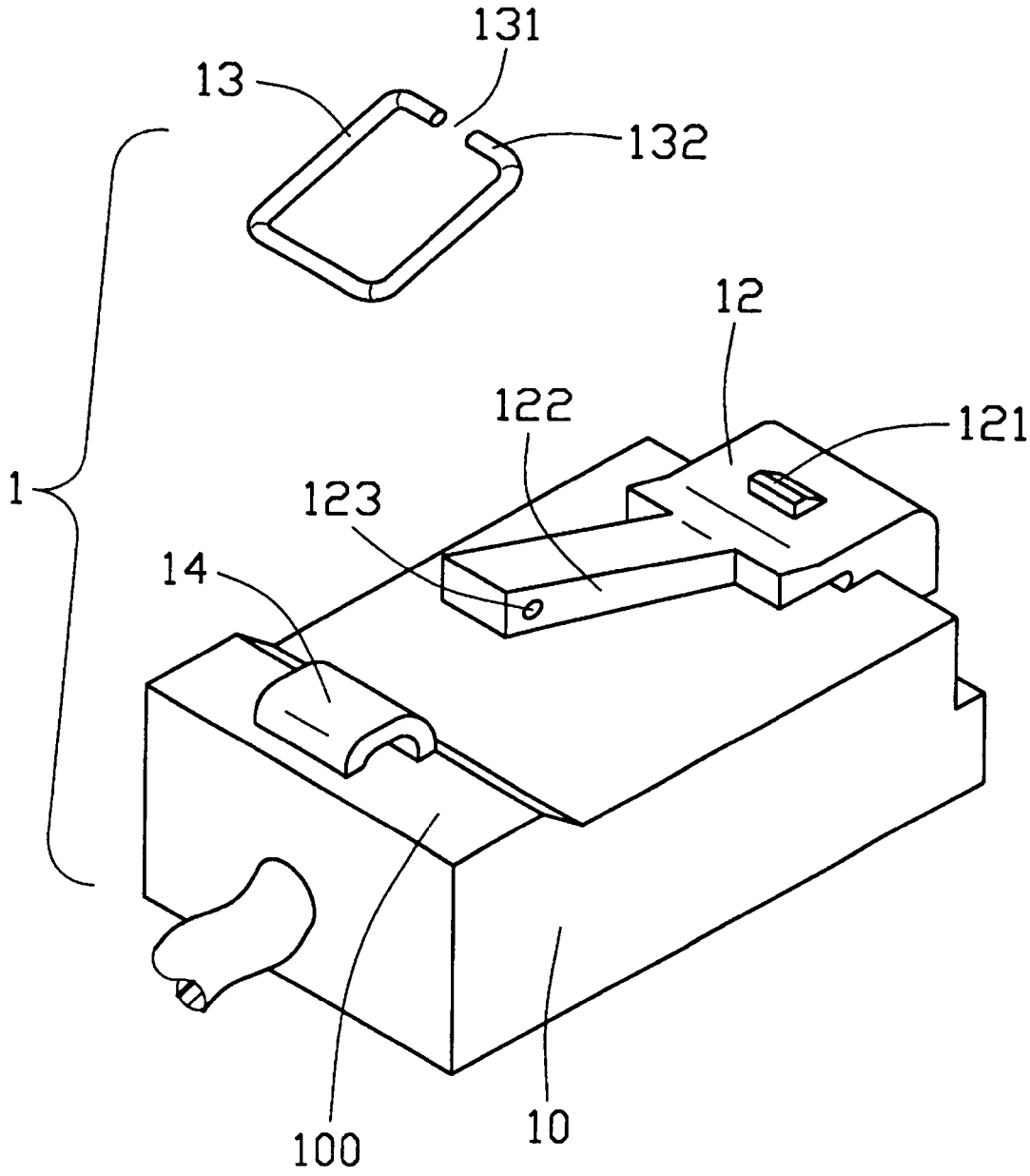
FIG. 1 is an exploded view of an electrical connector in accordance with the present invention.

Referring to FIG. 1, an electrical connector 1 in accordance with the first embodiment comprises an insulative housing 10, a plurality of terminals (not shown) received in the insulative housing, a latch 12 extending from the insulative housing 10 and a restraining device.

The latch 12 defines a barb 121 on a front end thereof to engage with certain feature (not shown) of a mating connector (shown in FIG. 4) and an impending end 122 on a rear end thereof. A pair of inserting holes 123 or a through hole is defined at or though two edges of the impending end 122. A connecting piece 14 is formed above a first face 100 defined on the insulative housing 10 and extends rearwardly. The retraining device in the embodiment is a metallic loop wire 13 which is a stretch piece and has a rectangular configuration. The loop wire 13 defines two inserting portions 132 and an opening 131 is defined between the two inserting portions 132.

Figure 2:
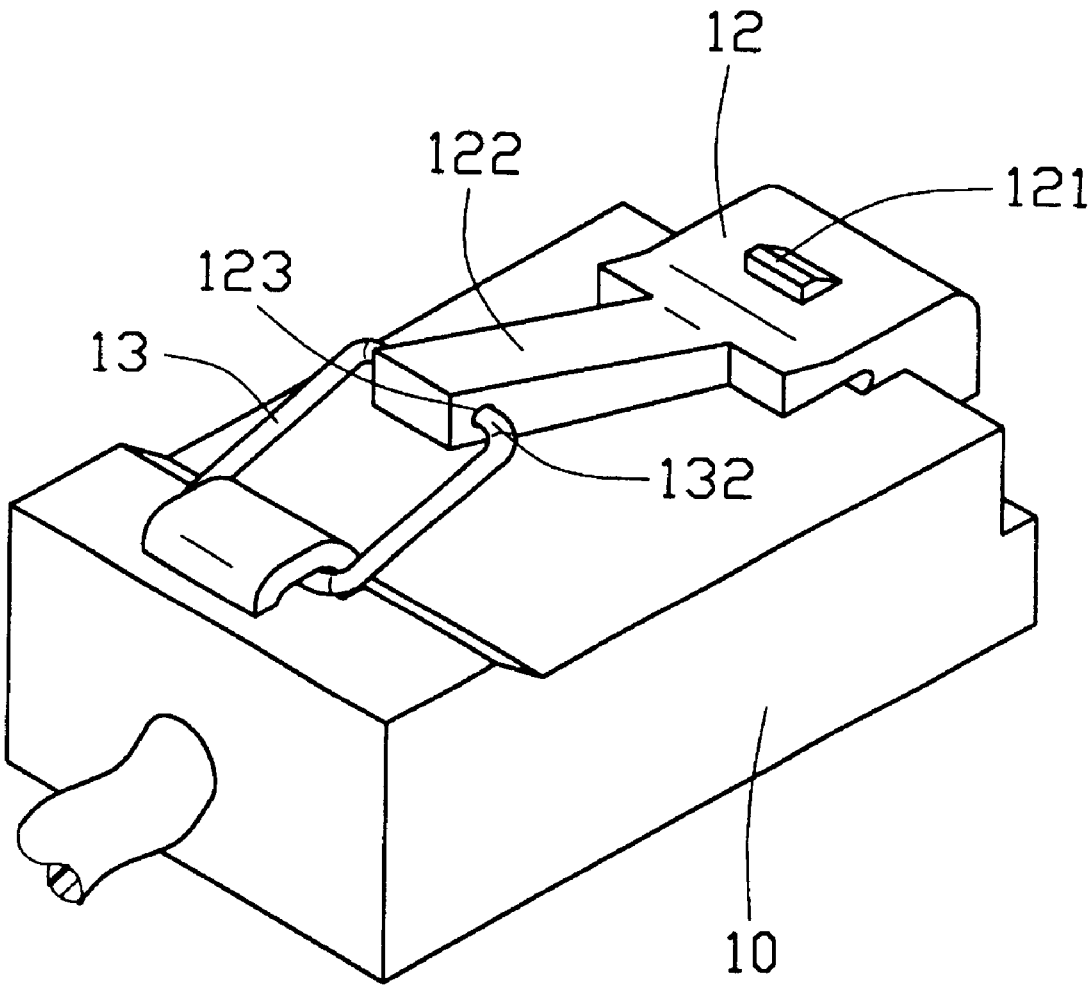
FIG. 2 is a perspective view of the electrical connector in accordance with the present invention.

Referring to FIG. 2, after the terminals are received in the insulative housing 10 and the latch 12 is assembled on the insulative housing 10, the loop 13 slides along the first face 100 and hitches the connecting piece 14. The inserting portions 132 are inserted into the inserting holes 123 of the impending end 122 of the latch 12. By this arrangement, the restraining device (the loop 13 in the embodiment) will prevent the latch 12 from being damaged while the impending end 122 is pulled outwardly.

Figure 3:
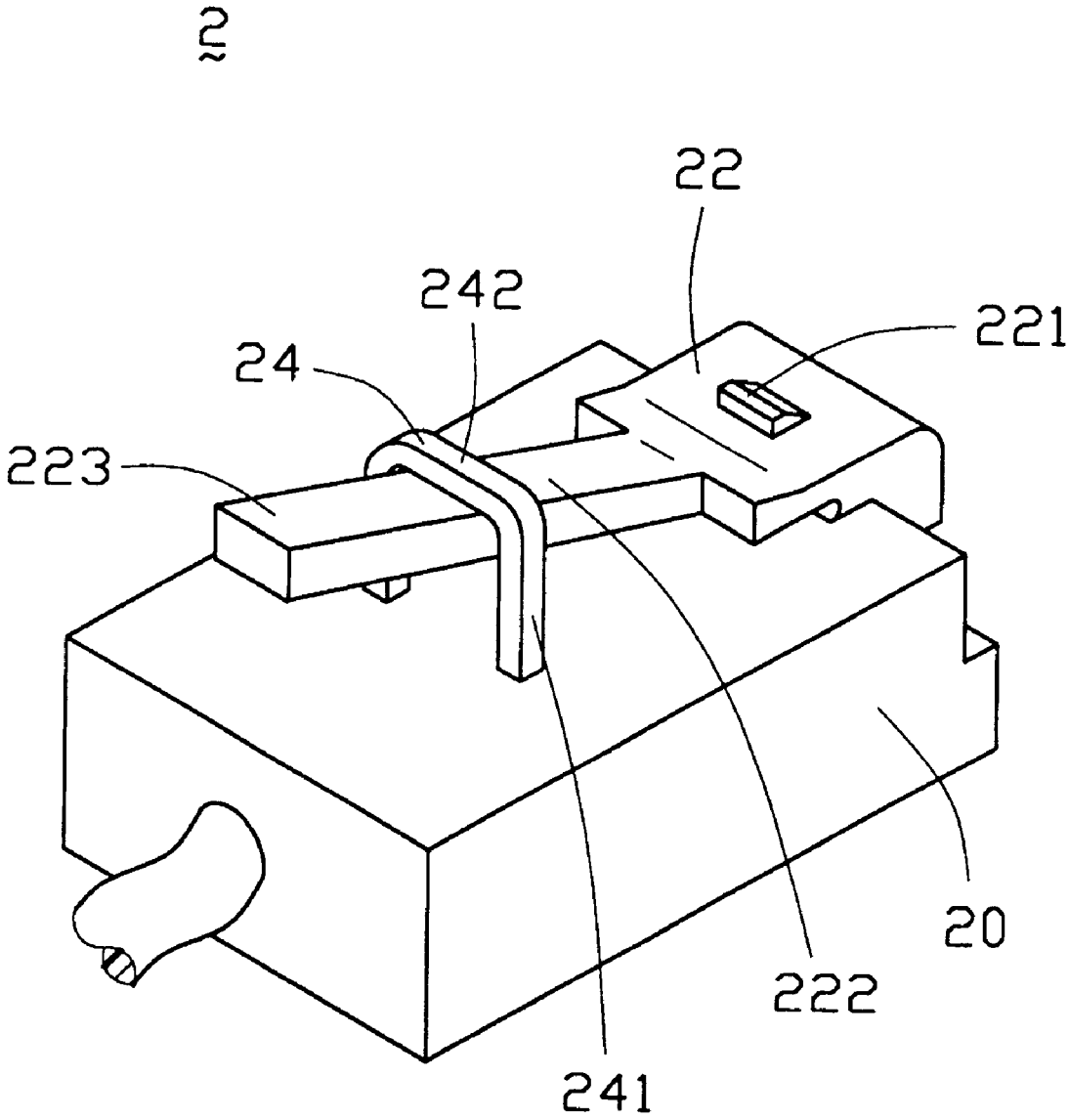
FIG. 3 is a perspective view of an electrical connector of an alternative embodiment in accordance with the present invention.

It is noted above that FIG. 3 has disclosed another embodiment of an electrical connector 2 in accordance with the present invention. The electrical connector 2 comprises an insulative housing 20, a plurality of terminals (not shown) received in the insulative housing 20, a latch 22 and a restraining device. The latch 22 defines a barb 221 on the front end to engage with a mating connector (shown in FIG. 4) and an impending end 222 on the rear end of the latch 22. The restraining device is a frame 24 having two posts 241 and a limiting portion 242 integrally formed on the insulative housing 20. The limiting portion 242 is formed above the impending end 222 of the latch 22. A rear portion 223 of the latch 22 extends beyond the limiting portion 242 rearwardly. By this arrangement, the restraining device (the frame 24 in this embodiment) is able to prevent the latch 22 from being damaged while the impending end 222 is pulled outwardly.

Figure 4:
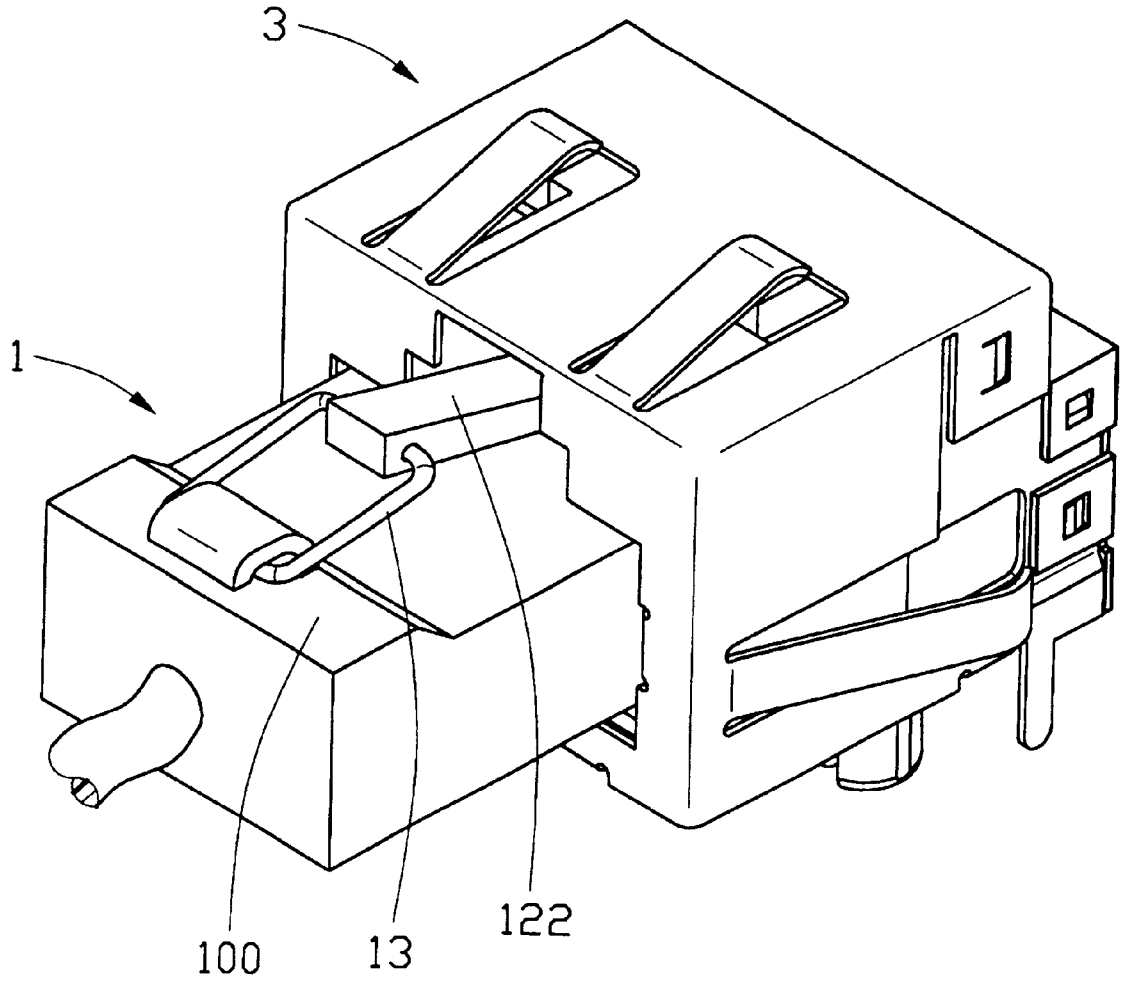
FIG. 4 is a perspective view of the electrical connector of FIG. 1 being inserted in a mating connector.

Referring to FIG. 4, the electrical connector 1 engages with a mating connector 3. The barb 121 (referring to FIG. 2) is inserting into the mating connector 3 and interferes with an interfering means (not shown) thereof. The impending end 122 is extending out of the mating connector 3. The loop 14 will slide along the first face 100 rearwardly and the barb 121 will be released when the impending end 13 is being pressed, whereby the electrical connector 1 is easy to be pulled out of the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a first face and a connecting piece extending rearwardly therefrom above the first face;

a latch extending from said insulative housing and having an impending end at a rear portion thereof; and a restraining device comprising a loop with a first end connected with said impending end of said latch and a second end movably connected with said connecting piece.

2. The electrical connector as claimed in claim 1, wherein said connecting piece has one point connected with said insulative housing.

3. The electrical connector as claimed in claim 1, wherein said restraining device is a stretch piece.

4. An electrical connector comprising:

an insulative housing;

a latch integrally extending rearwardly from a front portion of the housing;

a locking barb formed on a front portion of said latch; and a restraining device comprising a loop positioned at a back of said latch; wherein a front portion of said restraining device is pivotally connected to a rear portion of said latch, while a rear portion of the restraining device is somewhat freely slidable along a rear portion of the housing; and wherein said restraining device is configured to be adapted to be pressed against manually.

5. The connector as claimed in claim 4, wherein the rear portion of said restraining device is relatively confined by the rear portion of the housing in both horizontal and vertical directions so as to have a restraining function with regard to the latch.

* * * * *